United States Patent [19]

Heckmann et al.

[11] Patent Number: 4,790,960

[45] Date of Patent: Dec. 13, 1988

[54] PROCESS FOR THE STRIPPING OF CESIUM IONS FROM AQUEOUS SOLUTIONS

[75] Inventors: Klaus Heckmann, Regensburg; Walter Rieger, Laaber-Hinterzhof; Reinhard Kroebel, Gondelsheim, all of Fed. Rep. of Germany

[73] Assignee: Kernforschungszentrum Karlsruhe GmbH, Fed. Rep. of Germany

[21] Appl. No.: 824,326

[22] Filed: Jan. 30, 1986

[30] Foreign Application Priority Data

Jan. 17, 1985 [EP] European Pat. Off. ..... 86100612.0
Jan. 30, 1985 [DE] Fed. Rep. of Germany ..... 3502986

[51] Int. Cl.[4] ..... G21F 9/08; G21F 9/00

[52] U.S. Cl. ..... 252/631; 210/682; 252/626; 252/627; 423/2; 423/184; 423/185; 568/6

[58] Field of Search ..... 252/626, 627, 631; 210/682, 638; 75/121; 423/2, 12, 181, 3, 184, 179, 185; 260/705

[56] References Cited

U.S. PATENT DOCUMENTS

| | | | |
|---|---|---|---|
| 2,982,785 | 5/1961 | McKenzie | 210/638 |
| 4,432,893 | 2/1984 | Lee et al. | 252/631 |
| 4,452,702 | 6/1984 | Blasius et al. | 210/638 |
| 4,460,474 | 7/1984 | Blasius et al. | 210/679 |

*Primary Examiner*—Stephen J. Lechert, Jr.
*Assistant Examiner*—Howard J. Locker
*Attorney, Agent, or Firm*—Sughrue, Mion, Zinn, Macpeak & Seas

[57] ABSTRACT

A process for the stripping of cesium ions from an aqueous solution in which a precipitation agent is added to the aqueous solution and the resulting precipitate, containing the $CS^+$ ions is stripped from the solution. Sodium or lithium tetraphenylborates, carrying electron-attracting substituents on the phenyl rings are employed as precipitation agent.

10 Claims, No Drawings

PROCESS FOR THE STRIPPING OF CESIUM IONS FROM AQUEOUS SOLUTIONS

BACKGROUND OF THE INVENTION

The present invention relates to a process for the stripping of cesium ions from aqueous solutions in which a precipitation agent is added to the aqueous solution and the resulting precipitate, containing the $Cs^+$ ions, is stripped from the solution.

Cs-137 in its property as hard gamma ray emittor, is a particularly undesirable fission product in medium radioactive aqueous waste products (MAW), and renders more difficult the processing and solidification of MAW. A prior selective stripping of the Cs-137 would considerably simplify the further processing of medium radioactive waste products. After stripping the Cs-137 from the MAW, the shielding of the concentrate and/or the solidified ultimate waste package could be totally or at least partially omitted. In addition, such a process could also be profitably used for obtaining or stripping of Cs isotopes from highly active waste solutions as they occur, for example, in the reprocessing of nuclear fuels in the first extraction cycle. Here, the extraction of pure isotopes or isotope mixtures of cesium would be of practical importance for radio-chemical use and as radiation or heat source.

In the past, attempts have been made to precipitate $Cs^+$ ions with sodium tetraphenylborate (commercial name Kalignost), but it has been determined that such a precipitation cannot be done either selectively or in an acid milieu.

The stripping of cesium is done, according to a known process, mainly by coprecipitation reactions. However, the coprecipitation does not supply satisfactory decontamination factors for Cs (DF values). Thus, other processes were locked for which would permit a selective stripping of the cesium radionuclides.

The extraction procedures which have so far been developed for $Cs^+$ ions are not suitable for stripping $Cs^+$ from a typical MAW with its high content of $NaNO_3$ and free nitric acid.

J. Rais and P. Selucky proposed an extraction system for stripping $Cs^+$ from aqueous solutions, which uses 2,3,11,12-dibenzo-1,4,7,10,13,16-hexa-oxo-cyclo-octadeca-2,11-dien (dibenzo-18-crown-6DB-18-C-6 for short) in an organic phase and sodium tetraphenylborate was added to the aqueous phase which forms a $Cs^+$ containing adduct to be extracted. (Czechoslovakian Patent CS-PS No. 149,404). However, the process is limited to alkaline $Cs^+$ solutions (pH 11 to 13) because sodium tetraphenylborate is hydrolyzed in the acid range. In addition, the process only works well in the absence of substantial amounts of $Na^+$ and $K^+$.

SUMMARY OF THE INVENTION

A primary object of the present invention is to provide a process of the type stated above in which cesium can be stripped selectively, with high effectiveness from aqueous solution, as compared to other alkaline metal cations, such as $Li^+$, $Na^+$ and $K^+$.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, the present invention provides a process for the stripping of cesium ions from aqueous solution in which a precipitation agent is added to the aqueous solution and the resulting precipitate, containing the $Cs^+$ ions, is separated from the solution, comprising adding a sodium or lithium tetraphenylborate having electron-attracting substituents on the phenyl rings as a precipitation agent.

Preferably, the compounds which are used as precipitation agents are compounds in which the phenyl rings are substituted one to five times. Particularly good results are obtained with a compound which is disubstituted, in each of its phenyl rings in the 2,4 positions of the phenyl rings. However, compounds which are fourfold substituted in each of its phenyl rings in the 2,3,5,6 positions of the phenyl rings, or fivefold substituted in each of its phenyl rings in the 2,3,4,5,6 positions of the phenyl rings can also be successfully used. A particularly advantageous version of the process according to the present invention occurs when the substituents on the phenyl rings are fluorine atoms.

An effective embodiment of the process occurs when the addition of the precipitation agent and/or the precipitation reaction, as such, takes place or is done at a temperature of between 239° K. and 303° K. Preferably, the precipitation agent is added to the solution at a slight excess with regard to the cesium content, e.g. between 1.2 times to 5 times the stoichiometrically-needed amounts. The stripping of the precipitates, can be done, for example, either through filtration, liquid extraction, centrifugation or flotation.

A particularly good stripping is attained with the process according to the invention when the solution containing the cesium ions (a) is adjusted to a $Cs^+$ concentration in the range of between $10^{-1}$ and $10^{-3}$ mol/l and (b) the precipitation agent is added to the solution from step (a) and the resulting precipitate is stripped off. Steps (a) and (b) can be repeated at least once to achieve a desired decontamination of existing Cs-137 with the repetition of step (a) being conducted with inactive cesium (as carrier). Thus, in the repetition of step (a) inactive cesium is added to adjust the solution to the concentration in the range of between $10^{-1}$ and $10^{-3}$ mol/l.

The precipitation reaction preferably takes place in the presence of an acid concentration in the range of between 0 and 6 mol/l. In one preferred embodiment of the present invention, the separation of the precipitate from the solution occurs by means of extraction with an organic solvent. For example, chloroform; diethyl ether ligroine (b.p. 40°-60° C.) 2:1 [vol./vol.]; 4-methyl-2-pentanone (5% by volume in chloroform); or 4-methyl-2-pentanone (5% by volume in toluol) can be employed as organic solvent.

It is understood that both the foregoing general description and the following detailed description are exemplary and explanatory, but are not restrictive of the invention.

DETAILED DESCRIPTION OF THE INVENTION

It has been found in accordance with the present invention that the acid stability of the precipitation agent molecule and of the resulting precipitate which has low solubility is increased by the introduction of electron-attracting substituents in the phenyl rings of the molecule which prevents to a large extent that positive charges stabilize on the phenyl rings and thus initiate the decomposition of the molecule. The electron-attracting substituents protect the phenyl rings from electrophilic attacks.

The synthesis for the precipitation agents, usable for the process according to the present invention can occur, e.g., according to the following scheme:

Preparation of Sodium Tetrakis(2,4-difluorophenyl)borate:

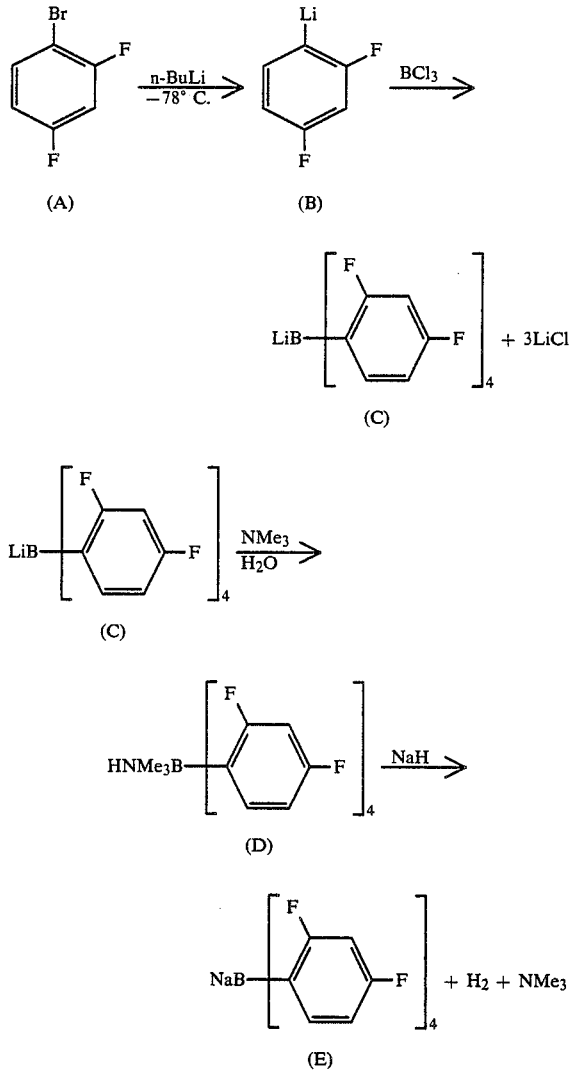

In the above process, 2,4-difluorobromobenzole (a) in a di-ethyl-ether solution is transformed at −78° C. into a phenyllithium derivative (B) with n-butyllithium (n-BuLi). Into the thus obtained phenyllithium derivative (B) solution, a $BCl_3$ solution in hexane is dripped. After warming up to room temperature, hydrolization is done, the ether pulled off over water, the aqueous phase (now containing derivative (c)) mixed with some active carbon, filtered and mixed with an aqueous trimethylamine solution. The resulting trimethylammonium salt (D) is recrystallised from methanol/water and dried. With sodium hydride it is transformed into the corresponding alkaline salt (E), which, as needed, can then be recrystallized from chloroform/acetone.

The compound lithiumtetrakis(2,3,5,6-tetrafluorophenyl)borate was produced in the same manner by employing lithium hydride instead of sodium hydride.

The lithiumtetrakis(pentafluorophenyl)borate production has been taken from A. G. Massey, A. J. Park: J. Organometal. Chem., 2 (1964), pages 245 to 250.

The products were analyzed with the aid of IR, NMR and elementary analysis. In order to present the salts in pure form, the "detour" through trimethylammonium salts is needed. However, for precipitation reactions, the aqueous solution of the precipitation reagents (containing derivatives according to derivatives "C" respectively) is already sufficient, the concentrations of which can be simply determined by quantitative precipitation with trimethylamine.

The solubilities of the corresponding Cs salts in pure water (298° K.) are given below:

Sodium tetrakis(2,4-difluorophenyl)borate: $2.0.10^{-4}$ mol/l

Lithium tetrakis(2,3,5,6-tetrafluorophenyl)borate: $3.7.10^{-4}$ mol/l

Lithium tetrakis(pentafluorophenyl)borate: $2.4.10^{-4}$ mol/l

The solubilities were determined by means of radiometry.

All reagents from precipitates with $Cs^+$ which have a low solubility, but not with potassium. Coprecipitation of potassium appears in lithium tetrakis(2,3,5,6-tetrafluorophenyl)borate but only with a $K^+$ to $Cs^+$ ratio of $\geqq 100$, and appears with sodiumtetrakis(2,4-difluorophenyl)borate and lithiumtetrakis(pentafluorophenyl)borate only at $K^+$ to $Cs^+$ ratio of $>100$.

$Cs^+$ precipitates which have a low solubility also form with sodium tetrakis(4-fluorophenyl)borate, sodium tetrakis(3,4-difluorophenyl)borate, and with lithiumtetrakis(2,4,6-trifluorophenyl)borate, with the precipitate of the first two compounds being formed in neutral and in alkaline media in a very good selectivity, and the precipitate of the third compound also being formed in acid media up to 3 molar acid, but for this compound coprecipitation with $K^+$ occurs from the ratio of $K^+$:$Cs^+$ as 1 up to higher $K^+/Cs^+$ ratios.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

($Cs^+$ Precipitation from a Simulated MAW)

A simulated MAW solution was prepared having the composition shown in Table 1.

TABLE 1

Sample Composition of the Simulated MAW Solution

| Element | Used as | Concentration (Mol/l) |
|---|---|---|
| Na | $NaNO_3$ | 3.53 |
| Al | $Al(NO_3)_3 9H_2O$ | $8.52 \cdot 10^{-3}$ |
| Ca | $Ca(NO_3)_2 4H_2O$ | $3.68 \cdot 10^{-2}$ |
| Cr | $Cr(NO_3)_3 9H_2O$ | $1.54 \cdot 10^{-3}$ |
| Cu | $Cu(NO_3)_3 3H_2O$ | $2.36 \cdot 10^{-3}$ |
| Fe | $Fe(NO_3)_3 9H_2O$ | $6.80 \cdot 10^{-3}$ |
| K | $KNO_3$ | $2.50 \cdot 10^{-3}$ |
| Mg | $Mg(NO_3)_2 6H_2O$ | $3.09 \cdot 10^{-2}$ |
| Mn | $Mn(NO_3)_2 4H_2O$ | $1.46 \cdot 10^{-3}$ |

TABLE 1-continued

| Sample Composition of the Simulated MAW Solution | | |
|---|---|---|
| Element | Used as | Concentration (Mol/l) |
| Mo | $Na_2MoO_42H_2O$ | $3.96 \cdot 10^{-3}$ |
| Ni | $Ni(NO_3)_26H_2O$ | $1.36 \cdot 10^{-3}$ |
| Ru | $Ru(NO_3)_3(NO)$8.8% ig | $7.50 \cdot 10^{-4}$ |
| Zn | $Zn(NO_3)_24H_2O$ | $2.29 \cdot 10^{-3}$ |
| TBP | | $7.51 \cdot 10^{-4}$ |
| DBP | | $9.51 \cdot 10^{-4}$ |
| $HNO_3$ | | 1.0 |

The simulated MAW was mixed with inactive $Cs^+$. Two different solutions were prepared, one with a $Cs^+$ concentration $1.0 \cdot 10^{-3}$ and the second with a $Cs^+$ concentration of $1.0 \cdot 10^{-2}$ mol/l. The solutions were doped with Cs-137, and this doping was independent of the inactive $Cs^+$ concentration, to provide an activity of 1 $\mu$Ci/ml. In each case, the precipitation agent was added in a threefold amount of the stoichiometric amount with respect to the $Cs^+$ concentration, whereby it was of no importance if it was added as solution or solid matter. Samples were taken after about 24 hours, they were filtered, the activity of the filtrate measured and the $Cs^+$ concentration then calculated through calibration. The results are shown in Tables 2 to 4.

The following compounds were used as precipitation agents:

(1) Sodiumtetrakis(2,4-difluorophenyl)borate
(2) Lithiumtetrakis(2,3,5,6-tetrafluorophenyl)borate
(3) Lithiumtetrakis(pentafluorophenyl)borate

TABLE 2

| $Cs^+$ Precipitation with Compound (1) | | |
|---|---|---|
| Initial Inactive $Cs^+$ Concentration [mol/l] | Temperature [°K.] | Remaining $Cs^+$ Concentration in the Solution After Stripping of Precipitate [mol/l] |
| $1.0 \cdot 10^{-3}$ | 293 | $6.0 \cdot 10^{-5}$ |
| $1.0 \cdot 10^{-3}$ | 277 | $3.7 \cdot 10^{-5}$ |
| $1.0 \cdot 10^{-3}$ | 260 | $1.6 \cdot 10^{-5}$ |
| $1.0 \cdot 10^{-2}$ | 293 | $5.6 \cdot 10^{-5}$ |
| $1.0 \cdot 10^{-2}$ | 277 | $3.5 \cdot 10^{-5}$ |
| $1.0 \cdot 10^{-2}$ | 260 | $1.3 \cdot 10^{-5}$ |

TABLE 3

| $Cs^+$ Precipitation with Compound (2) | | |
|---|---|---|
| Initial Inactive $Cs^+$ Concentration [mol/l] | Temperature [°K.] | Remaining $Cs^+$ Concentration in the Solution After Stripping of Precipitate [mol/l] |
| $1.0 \cdot 10^{-3}$ | 293 | $3.0 \cdot 10^{-4}$ |
| $1.0 \cdot 10^{-3}$ | 277 | $1.9 \cdot 10^{-4}$ |
| $1.0 \cdot 10^{-2}$ | 293 | $3.0 \cdot 10^{-4}$ |
| $1.0 \cdot 10^{-2}$ | 277 | $1.8 \cdot 10^{-4}$ |

TABLE 4

| $Cs^+$ Precipitation with Compound (3) | | |
|---|---|---|
| Initial Inactive $Cs^+$ Concentration [mol/l] | Temperature [°K.] | Remaining $Cs^+$ Concentration in the Solution After Stripping of Precipitate [mol/l] |
| $1.0 \cdot 10^{-3}$ | 293 | $1.8 \cdot 10^{-4}$ |
| $1.0 \cdot 10^{-3}$ | 277 | $6.8 \cdot 10^{-5}$ |
| $1.0 \cdot 10^{-2}$ | 293 | $1.6 \cdot 10^{-4}$ |
| $1.0 \cdot 10^{-2}$ | 277 | $5.4 \cdot 10^{-5}$ |

EXAMPLE 2

($Cs^+$ Precipitation from 5M-Nitric Acid)

The same procedure was employed as described in Example 1, except that only Compounds (1) and (3) were tested as precipitation agents, and the acid molarity of the aqueous solution used was chosen in such a manner that in this context it simulated a HAW concentrate (HAW=high radioactive aqueous waste).

To prepare the aqueous solution, 5 molar $HNO_3$ was mixed with inactive $Cs^+$ to provide a $Cs^+$ concentration of $1.0 \cdot 10^{-2}$ mol/l. The solution was doped with Cs-137 to provide an activity of 1 $\mu$ Ci/ml. The precipitation agent was added in a threefold amount of the stoichiometric amount with respect to the $Cs^+$ concentration. After 24 hours, samples were taken, they were filtered, the activity of the filtrate measured and the $Cs^+$ concentration calculated via calibration. The results are shown in Tables 5 and 6.

TABLE 5

| $Cs^+$ Precipitation with Compound (1): | | |
|---|---|---|
| Initial Inactive $Cs^+$ Concentration [mol/l] | Temperature [°K.] | Remaining $Cs^+$ Concentration in the Solution After Stripping of Precipitate [mol/l] |
| $1.0 \cdot 10^{-2}$ | 293 | $2.6 \cdot 10^{-5}$ |
| $1.0 \cdot 10^{-2}$ | 273 | $1.8 \cdot 10^{-5}$ |
| $1.0 \cdot 10^{-2}$ | 260 | $1.5 \cdot 10^{-5}$ |

TABLE 6

| $Cs^+$ Precipitation with Compound (3): | | |
|---|---|---|
| Initial Inactive $Cs^+$ Concentration [mol/l] | Temperature [°K.] | Remaining $Cs^+$ Concentration in the Solution After Stripping of Precipitate [mol/l] |
| $1.0 \cdot 10^{-2}$ | 313 | $1.6 \cdot 10^{-3}$ |
| $1.0 \cdot 10^{-2}$ | 298 | $8.4 \cdot 10^{-4}$ |
| $1.0 \cdot 10^{-2}$ | 273 | $6.9 \cdot 10^{-4}$ |
| $1.0 \cdot 10^{-2}$ | 260 | $6.4 \cdot 10^{-4}$ |

Sodium tetrakis(2,4-difluorophenyl)borate (Compound 1) is acid stable to 6M-$HNO_3$ and at temperatures up to 293° K. Under conditions as they are prevalent in radioactive waste solutions, the Cs salt has the lowest solubility of the compounds examined. The remaining $Cs^+$ concentration in MAW-simulate or in 5M nitric acid, depending on temperature (239° to 293° K.), are between $1.0 \cdot 10^{-5}$ and $8.0 \cdot 10^{-5}$ mol/l. (With Kalignost such a solubility determination cannot be done, as the decomposition of the compound occurs too fast under the test conditions).

The lowest $Cs^+$ concentration to be reached by precipitation is determined by the solubility of the corresponding $Cs^+$ salts.

EXAMPLE 3

($Cs^+$ Precipitation from Simulated HAW)

A simulated HAW solution was prepared having the composition shown in Table 7. The simulated solution was 5 molar in $HNO_3$ and contained the largest amount of elements in the form of nitrate salts.

TABLE 7

| Element | Concentration in the Simulated Aqueous solution (g/l) |
|---|---|
| Ag | 0.03 |
| Ba | 2.65 |
| Cd | 0.14 |
| Ce | 3.70 |
| Cr | 0.57 |
| Cs | 3.54 |
| Eu | 0.28 |
| Fe | 2.19 |
| Gd | 0.25 |
| La | 1.90 |
| Mn | 0.06 |
| Mo | 5.24 |
| Nd | 6.16 |
| Pd | 2.01 |
| Pr | 1.78 |
| Rb | 0.49 |
| Rh | 0.57 |
| Ru | 2.13 |
| Sb | 0.009 |
| Se | 0.08 |
| Si | 0.04 |
| Sm | 1.35 |
| Sn | 0.06 |
| Sr | 1.15 |
| Tc | 2.26 |
| Te | 0.74 |
| Y | 0.66 |
| Zr | 5.27 |
| Rest | 0.03 |
| Active Compound (Am, Cm, Np, Pu, U) | 4.55 |
| Impurities | 0.63 |

The solution was doped with Cs-137 to provide an activity of 1 μCi/ml. The precipitation was done as described in Example 2, but only with Compound (3). The result is shown in Table 8:

TABLE 8

| Precipitation with Compound (3) | | |
|---|---|---|
| Initial Inactive $Cs^+$ Concentration [mol/l] | Temperature [°K.] | Remaining $Cs^+$ Concentration in the Solution After Stripping of Precipitate [mol/l] |
| $2.68 \cdot 10^{-2}$ | 298 | $7.2 \cdot 10^{-4}$ |
| $2.68 \cdot 10^{-2}$ | 283 | $6.2 \cdot 10^{-4}$ |
| $2.68 \cdot 10^{-2}$ | 273 | $5.9 \cdot 10^{-4}$ |

EXAMPLE 4

(Effectiveness)

It is now possible to obtain by precipitation, for example with Compound (1), high decontamination for Cs-137 in various ways and manners as follows:

(1) Adjusting the MAW solution to an inactive $Cs^+$ concentration of $1.0 \cdot 10^{-3}$ mol/l. Precipitation at a temperature of 293° K. with Compound (1) in a threefold amount of the stoichiometric amount with respect to the $Cs^+$ concentration and stripping the precipitate (by filtration or centrifugation) supplies a decontamination factor (DF) of 17. The resulting $Cs^+$ concentration of about $6.0 \cdot 10^{-5}$ mol/l is again adjusted to $1.0 \cdot 10^{-3}$ mol/l, again precipitated and the whole process repeated as often as desired. With four cycles it is thus possible to attain, without much material investment, a DF for the active Cs of about 80,000 (precipitation temperature 293° K. in each case).

(2) Adjusting the MAW solution to an inactive $Cs^+$ concentration of $1.0 \cdot 10^{-2}$ mol/l, and then following the same procedure as in (1) above. The first precipitation results in a DF of 170, after the next cycle, a DF of 29,000 etc. (Precipitation temperature in each case 293° K.).

(3) The same procedure is employed as in (1), except that the precipitation temperature is 277° K. The first precipitation produces a DF of 26, after the fourth precipitation the DF is higher than 400,000.

(4) The same procedure is employed as in (2), except that the precipitation temperature is 277° K. The first precipitation supplies a DF of 280, the second precipitation already a DF of more than 78,000.

(5) The same procedure is employed as in (1), except that the precipitation temperature is 260° K. The first precipitation supplies a DF of 62, after the third precipitation the DF is >230,000.

(6) The same procedure is employed as in (2), except that the precipitation temperature is 260° K. The first precipitation supplies a DF of 770, the second precipitation already a DF of >590,000.

(7) Adjusting a 5M $HNO_3$ to an inactive $Cs^+$ concentration of $10^{-2}$ mol/l. The process otherwise is the same as in (1). The first precipitation supplies a DF of 384, the second precipitation already a DF of 148,000. The precipitation temperature in each case was 293° K.

(8) The same procedure is employed as in (7), except that the precipitation temperature is 260° K. The first precipitation supplies a DF of 667, the second precipitation already a DF of 444,000.

EXAMPLE 5

(Separation of the Cs precipitate from Compound (3) by Liquid Extraction from an Aqueous Solution)

Water was mixed with inactive $Cs^+$ to provide a $Cs^+$ concentration of $1.0 \cdot 10^{-3}$ mol/l. The solution was doped with Cs-137, as in the previous examples. The precipitating agent was added in a double amount of the stoichiometric amount with respect to the $Cs^+$ concentration. After 24 hours, samples were taken and subjected to different precipitation separation methods, namely, filtration on the one hand, and extraction on the other, in order to compare the effectiveness of the different precipitation separation methods. In the filtration separation method, the precipitates were filtered off and the residual $Cs^+$ concentration in the filtrate solution of the samples determined. This $Cs^+$ concentration in the filtrate solutions amounted to $6.5 \cdot 10^{-5}$ mol/l.

In the extraction separation method, the solutions containing the precipitates were extracted using various organic solvents, and the residual $Cs^+$ concentrations in the aqueous phases were measured. The results are shown in Table 9.

TABLE 9

| Extraction from the Aqueous Solution | |
|---|---|
| Extraction Agent | Residual $Cs^+$ Concentration in the Solution after Extraction (mol/l) |
| Chloroform | $6.2 \cdot 10^{-5}$ |
| Diethyl ether/ligroine (b.p. 40–60° C.) 2:1 (vol./vol/) | $6.6 \cdot 10^{-5}$ |
| 4-methyl-2-pentanone (5% by volume in chloroform) | $6.6 \cdot 10^{-6}$ |
| 4-methyl-2-pentanone (5% by volume in toluol) | $6.9 \cdot 10^{-6}$ |

EXAMPLE 6

(Separation of the $Cs^+$ precipitates from Compound (3) by means of Liquid Extraction from a Simulated HAW.)

Execution of the experiments and the comparison of the separation methods occurred as described in Example 5, except that the precipitant was in this case added in a threefold amount of the stoichiometric amount with respct to the $Cs^+$ concentration. The residual $Cs^+$ after filtration of the samples amounted to $7.2 \cdot 10^{-4}$ Mol/l.

The result of the extractions are shown in Table 10.

TABLE 10

| Extraction from Simulated HAW Simulate: | |
|---|---|
| Extraction Agent | Residual $Cs^+$ Concentration in the Solution after Extraction (mol/l) |
| Chloroform | $7.1 \cdot 10^{-4}$ |
| Diethyl ether/ligroine (b.p. 40–60° C.) 2:1 (vol./vol/) | $6.3 \cdot 10^{-4}$ |
| 4-methyl-2-pentanone (5% by volume in chloroform) | $6.2 \cdot 10^{-5}$ |
| 4-methyl-2-pentanone (5% by volume in toluol) | $6.4 \cdot 10^{-5}$ |

Other organic solvents may also be used as extraction agents, however, they were not investigated for effectiveness.

It will be understood that the above description of the present invention is susceptible to various modifications, changes and adaptations, and the same are intended to be comprehended within the meaning and range of equivalents of the appended claims.

What is claimed is:

1. Process for selectively stripping cesium ions from a strongly acid aqueous radioactive waste solution in which a precipitation agent is added to the aqueous solution and the resulting precipitate, containing the $Cs^+$ ions, is separated from the solution, comprising: adding to the solution a sodium or lithium tetraphenylborate having electron-attracting substituents on the phenyl rings as the precipitation agent, said precipitation agent being a compound which is disubstituted in the 2,4 positions of each of the phenyl rings, or is fourfold substituted in the 2,3,5,6, positions of each of the phenyl rings, or is fivefold substituted in the 2,3,4,5,6 positions of each of the phenyl rings, and wherein the substituents are fluorine atoms.

2. Process according to claim 1, wherein the precipitation reaction takes place at a temperature between 239° K. and 303° K.

3. Process according to claim 1, wherein the precipitation agent is added in excess.

4. Process according to claim 3, wherein the precipitation agent is added in the amount of from 1.2 times to 5 times the stoichiometrically needed amount with regard to the $Cs^+$ concentration of the solution.

5. Process according to claim 1, wherein the solution containing the cesium ions (a) is adjusted to a $Cs^+$ concentration in the range from $10^{-1}$ to $10^{-1}$ mol/l, (b) the precipitation agent is added to the solution from step (a) and the resulting precipitate is separated off.

6. Process according to claim 5, wherein steps (a) and (b) are repeated at least once to achieve a desired decontamination of Cs-137, with the repetition of step (a) being conducted by adding inactive cesium as carrier to adjust the $Cs^+$ concentration.

7. Process according to claim 1, wherein the separation of the precipitate from the solution occurs by means of extraction with an organic solvent.

8. Process according to claim 7, wherein the solvent is chloroform, diethyl ether/ligroine (b.p. 40°–60° C.) 2:1 (vol./vol.), 4-methyl-2-pentanone (5% by volume in chloroform), or 4-methyl-2-pentanone (5% by volume in toluol).

9. Process according to claim 1, wherein the precipitation is conducted in the presence of an acid concentration of 3 to 6 mol/l.

10. Process according to claim 1, wherein the precipitation is conducted in the presence of an acid concentration in the range of 1 to 6 mol/l.

* * * * *